United States Patent [19]

Birk et al.

[11] Patent Number: 4,691,695

[45] Date of Patent: Sep. 8, 1987

[54] APPARATUS FOR MEDICAL TREATMENTS

[75] Inventors: Josef Birk, Lohmar; Friedhelm Baisch, Neunkirchen-Seelscheld; Heinz J. Borger, Siegburg-Kaldauen, all of Fed. Rep. of Germany

[73] Assignee: Deutsche Forschungs- und Versuchsanstalt fur Luft- und Raumfart e.V., Cologne, Fed. Rep. of Germany

[21] Appl. No.: 784,534

[22] Filed: Oct. 4, 1985

[30] Foreign Application Priority Data

Oct. 12, 1984 [DE] Fed. Rep. of Germany ..... 3437461

[51] Int. Cl.[4] ..... A61H 1/00; A61H 33/06

[52] U.S. Cl. ..... 128/38; 128/1 B; 128/373; 128/375

[58] Field of Search ..... 128/1 A, 1 B, 38, 90, 128/371, 373–375, DIG. 20, 402

[56] References Cited

U.S. PATENT DOCUMENTS

| | | | |
|---|---|---|---|
| 799,664 | 9/1905 | Norwood | 128/375 |
| 2,142,689 | 1/1939 | Emerson | 128/38 |
| 2,168,611 | 8/1939 | Thompson | 128/38 |
| 2,272,481 | 2/1942 | Rinkes et al. | 128/38 |
| 3,217,707 | 11/1965 | Werding | 128/38 |
| 3,877,427 | 4/1975 | Alexeev et al. | 128/1 B |
| 4,301,791 | 11/1981 | Franco | 128/DIG. 20 |
| 4,421,109 | 12/1983 | Thornton | 128/38 |

*Primary Examiner*—Kyle L. Howell
*Assistant Examiner*—John C. Hanley
*Attorney, Agent, or Firm*—Spensley Horn Jubas & Lubitz

[57] ABSTRACT

In an apparatus for medical treatments, examinations or tests comprising a chamber connectible to a vacuum source and having at its one end side a passage aperture with a flexible sealing member, the chamber is formed of a foldable bellow provided with a support structure adapted to be dismantled. In axial direction of the bellow, the support structure contains a plurality of substantially parallel-mounted peripheral members backing up peripherally the bellow and being mobile relative to each other, as well as mobile longitudinal stiffening elements secured to the peripheral members.

16 Claims, 7 Drawing Figures

APPARATUS FOR MEDICAL TREATMENTS

BACKGROUND OF THE INVENTION

1. Field of the Invention

The invention relates to an apparatus for medical treatments, examinations or tests comprising a chamber connectible to a vacuum source and having at its one end side a passage aperture with a flexible sealing member.

2. Description of the Invention

There has been known vacuum containers (German Patent No. 28 39 283) used for medical treatments and adapted to receive the lower body of the patient or testee, the container or chamber being closed airtightly and a vacuum pressure being produced in it upon the admission of the patient. Due to the reduced air and oxygen partial pressure, it is possible to gather information about the psychomotoric behaviour and blood circulation of the human body. Due to their size and weight, such apparatuses are locally bound in practice, their use outside a blood circulation test lab being prohibitive.

It is the object of an invention to provide an apparatus of the above mentioned type which is of a portable design, requiring little space and being of a low weight.

SUMMARY OF THE INVENTION

The problem is solved according to one embodiment of the invention in that the chamber is formed of a foldable bellow provided with a support structure adapted to be dismantled.

Such a foldable apparatus need not be mounted stationarily, but it may be used as a mobile unit outside labs for specific tests, for instance in orbital space to make medical tests when performing work under zero-gravity and under vacuum pressure conditions, e.g. tests concerning the failure of the sense of balance. Due to the apparatus of the invention, the chamber may be of a light-weight design having a sufficient stability under mechanical loads and not requiring much space when set up.

In the axial direction of the bellow, the support structure preferably contains a plurality of substantially parallel-mounted peripheral members backing up peripherally the bellow and being mobile relative to each other. Further it comprises mobile longitudinal stiffening elements which, on the one hand, are adapted to stretch the bellow skin to form the cavity of the vacuum chamber, and by which the bellow skin is supported against external pressure.

Due to the mobility of the longitudinal stiffening elements, the bellow may be folded without the need of disassembling the support structure elements.

According to one embodiment, each rod of the longitudinal stiffening elements is hinge-connected to a tensioning element of a peripheral member while at least one end is detachably locked at the adjacent tensioning element. By this means, a rigid connection between the peripheral members is ensured in axial direction of the bellow.

Preferably, the rods consist of two axially offset, interconnected rod arms which, in the central region of the offset plane are pivoted at each second tensioning element and whose respective ends may be locked with two adjacent tensioning elements. At the same time, the rod arms are interconnected via a rod connecting element which, by means of a hinge joint, is supported by the respective tensioning element. Further, via swivel joints, the rod arms may be so connected to the ends of the rod connecting elements that they may be swivelled radially to the inside relative to the bellow. As a result thereof, the space requirement of the bellow in telescoped condition is reduced once more in that the rod arms may rest against the bellow.

According to one advantageous embodiment, the swivel joints include a barrier to prevent the rod arms from swivelling to the outside in radial direction. Thus, the extracted bellow may not collapse under the action of vacuum pressure.

An angle of 90° between the longitudinal axis of the bellow and the peripheral elements is maintained because the rod arms being distributed peripherally cannot yield to the outside.

Adjacent to the pivot point on the tensioning elements, there are fixed two stops limiting the rotary angle of the rod arms. At least two longitudinal stiffening elements symmetrically fitted circumferentially comprise a different orientation of the displacement of the rod arms to thus obtain a high torsional resistance of the bellow and an increase of stability of the total device without a resultant higher weight or larger space requirement.

Another advantageous embodiment of the invention provides that the cross section of the passage aperture may be altered by a lamellar slide to permit to adapt the passage aperture to the body shape of the testee, while, with the application of a vacuum pressure, the flexible seal at the passage aperture may find its support at the lamellar slide.

BRIEF DESCRIPTION OF THE DRAWINGS

One preferred embodiment of the invention will be explained hereunder in more detail with reference to the enclosed drawings.

DESCRIPTION OF THE PREFERRED EMBODIMENT

Figure 1:
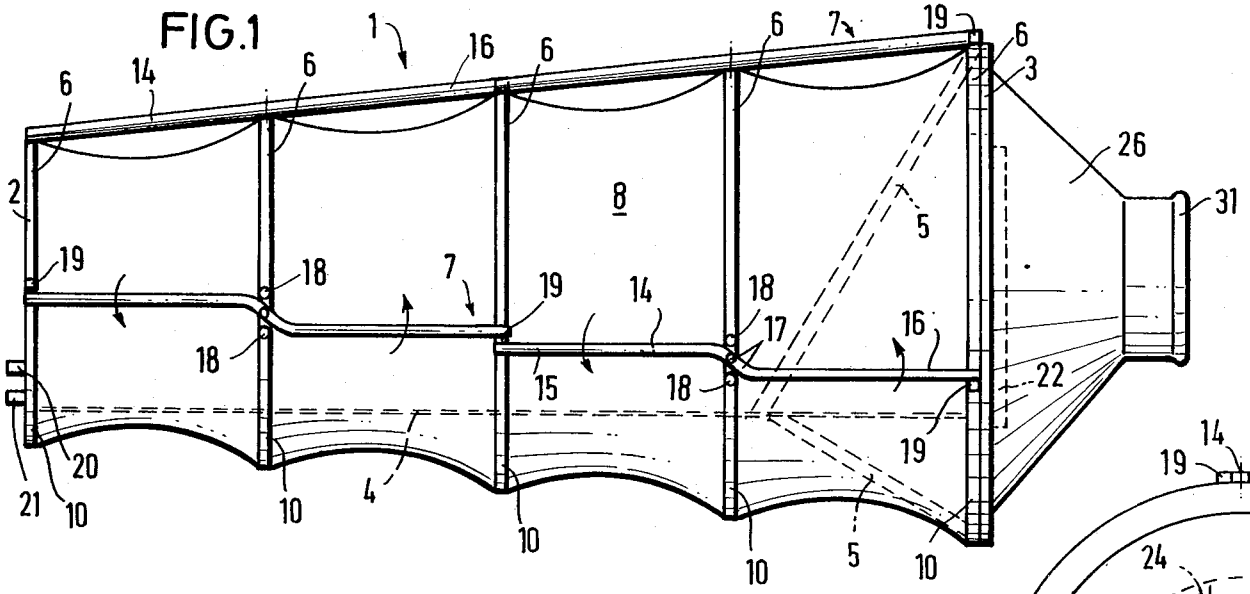
FIG. 1 is a side view of a bellow-type vacuum chamber in extracted condition.

The vacuum chamber of the apparatus illustrated in FIG. 1 is formed by drawing out a foldable bellow 1, which, when unfolded, is of a substantially frustoconical shape, whose one end side 2 is closed while a circumjacent annular flange 3 is provided at its other end side. A flexible rest surface e.g. a tarpaulin is fixed in the lower part of the vacuum chamber to serve as a support for a body, while a belt 5 engaging during an examination the crotch of the examinee offers the required backing so that he may not slip down too deeply into the vacuum chamber.

Bellow 1 consists of a support structure composed of rigid peripheral members 6 and of movable longitudinal reinforcing elements 7 as well as of a bellow skin of transparent plastic sheet of a high stability.

The bellow 1 with its support structure may rest on a non-illustrated underframe serving as a vertical support.

As for the peripheral elements 6, they each consist of an annular support tube 9 to back up the sheet material 8 from the radial inside, and of a bracing ring 10 peripherally enclosing the support tube 9 and being made of a straight-cylindrical ring portion 11 from whose two end sides a respective annular flange portion 12,13 projects radially to the inside and axially to the outside. With its annular groove formed by the ring portion 11 and the ring flange elements 12,13, the bracing ring 10 encompasses the support tube 9, the plastic sheet 8 of the bellow 1 being radially clamped between the bracing ring 10 and the support tube 9. At the radially circumjacent clamping point, the sheet material 8 is provided with a reinforcement which may be formed by an additional second sheet that may be applied by welding.

On the entire length of the bellow 1, there are mounted five parallel peripheral members 6 in total, which, in pulled-out condition of bellow 1, are mutually spaced axially at an equal distance. The diameter of said peripheral members 6 decreases towards the closed end plate 2 so as to save weight, on the one hand, and to permit an adaptation to the body shape, on the other hand.

The mentioned mobile longitudinal elements 7 are attached at the bracing rings 10 of the peripheral elements 6 and in their one end position, the bellow 1 may be stretched, while it may be folded up in their other end position. Each of the longitudinal stiffening elements 7 consists of a rod 14 pivoted at a bracing ring 10 and consisting of two axially mutually offset rod arms 15,16 being interconnected and joined to each other via a rod connecting element 17 extending substantially at an angle of 45°.

Figure 7:
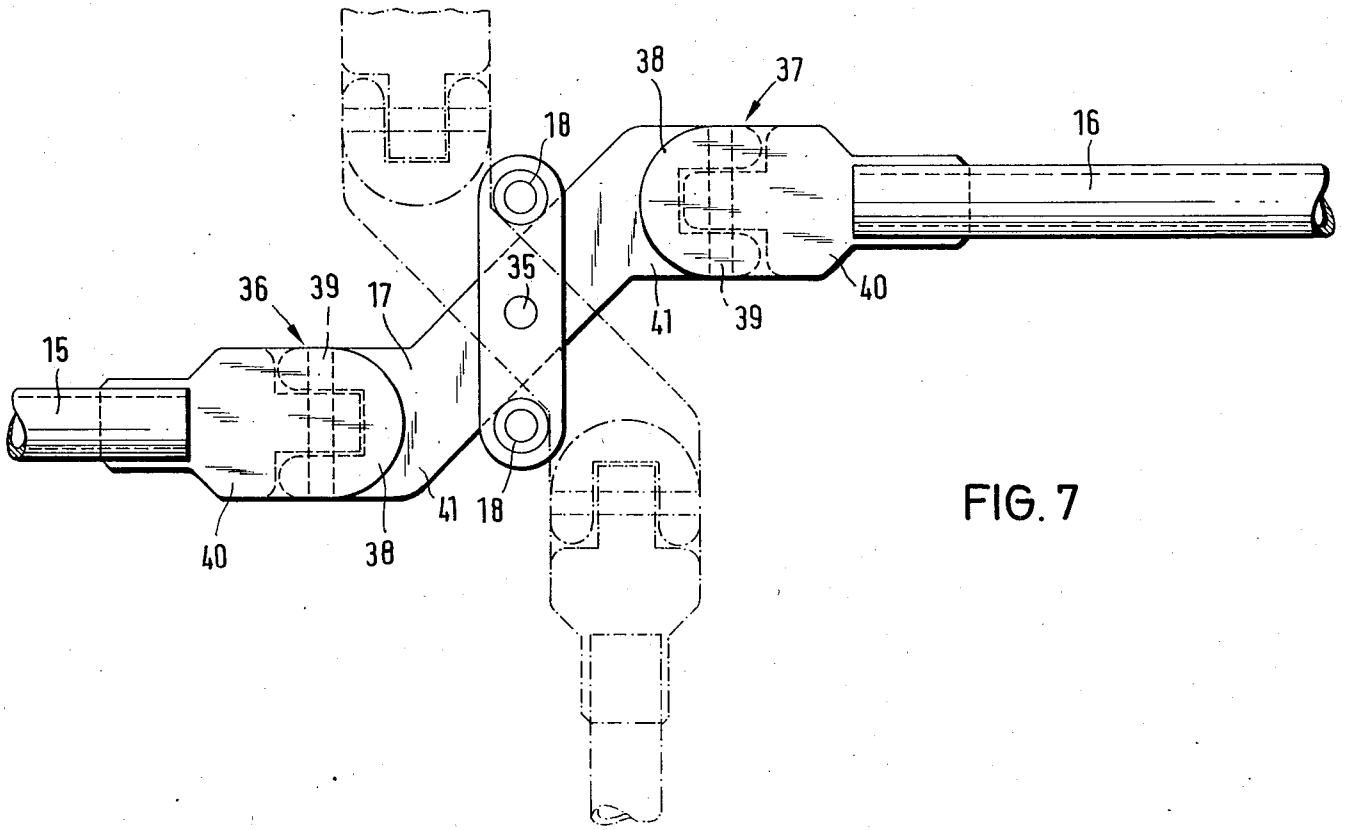

Said rod connecting element 17 is supported in a hinge joint 35 at the bracing ring 10 in an axis of symmetry extending vertically through the plane of displacement. In common with the rod arms 15 or 16, the ends of the rod connecting element 17 form a swivel joint 36,37 enabling the rod arms 15,16 to swivel radially inwardly relative to the bellow 1. One joint half of the swivel joints 36,37, for inst. rod arms 15,16 in FIG. 7, includes a barrier 38 only allowing an inward swivel of the rod arms 15,16, the barrier 38 inhibiting that, with vacuum action, the stretched out rod arms 15,16 allow a torsional movement of the bracing ring plane relative to the longitudinal axis of the bellow 1 or a collapse of said bellow 1. By the barriers 38 mounted at the hinge-side ends of the peripherally distributed rod arms 15,16, an angle of 90° is strictly maintained between the bracing rings 10 and the longitudinal bellow axis.

The axis of rotation of the swivel joints 36,37 is formed by bolts 39 extending in the plane of the respective rod connecting elements 17 and traversing a corresponding fork-shaped joint half 41 at the ends of the rod connecting element 17 and the end forming the second joint half 40 of the respective rod arm 15,16 and being inserted in the fork-shaped joint half 41. With respect to the bolt rotation axis, said joint halves 40 of the rod arms 15,16 have an external plate-shaped barrier 38 overengaging the corresponding joint 36,37 and inhibiting in connection with the rod connecting element a swivel movement of the rod arms 15,16 about the axis of rotation of bolt 39 towards the outside in that the barrier 38 abuts against the rod connecting element 17.

The length of the rod arms 15,16 is conformed to the desired distance between two peripheral elements 6. The ends of the rod arms 15,16 are caught in a lock 19 with the respective bracing ring 10. The rods 14 are supported externally at each second bracing ring 10 so that a longitudinal reinforcement 7 keeping apart five peripheral members 6 can be formed with two rods 14 accordingly. Three corresponding longitudinal stiffening elements 7 formed of two rods 14 each are peripherally distributed in a preferred vertical-symmetric arrangement. The bracing rings 10 forming the support of rods 14 comprise two stops 18 each situated above and beneath the pivot point of the rods 14 and limiting the swivel range to 90° of the corresponding rod 14 so that, in one stop position, the rod arms 15,16 extend horizontally in axial direction of the bellow while, in the other stop position, they extend in parallel to the peripheral members 6.

The displacement of the rod arms 15,16 in associated with the rod connecting elements 17 adjoining the stops 18 is responsible for an improved torsional stability of the bellow because, by the stops 18, a torsion-based rotation of the rods 14 beyond the extracted position is inhibited. One longitudinal stiffening element 7 extends substantially centrally of the bellow at its highest point, while two longitudinal stiffening elements 7 mounted vertically-symmetrically relative to each other extend at opposite peripheral sites in the lower portion of the bellow 1. The orientation of the respective rod connecting elements 17 at both sides of the bellow being the same in axial direction, torsional forces in both senses of rotation are caught accordingly.

Figure 2:
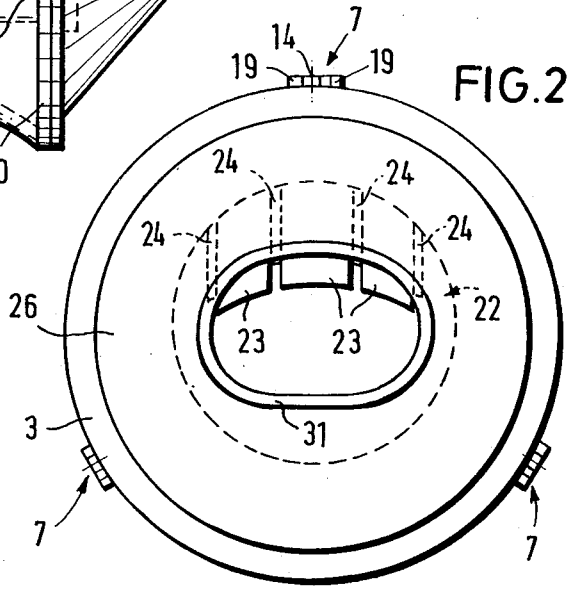
FIG. 2 is a front view of said chamber comprising a lamellar slide secured to an annular flange, and a sealing member.
Figure 3:
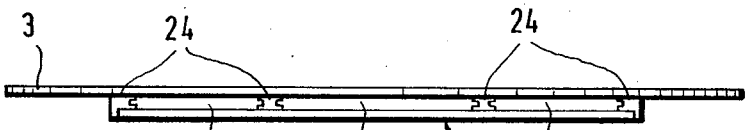
FIG. 3 is a plan view of the lamellar slide.
Figure 4:
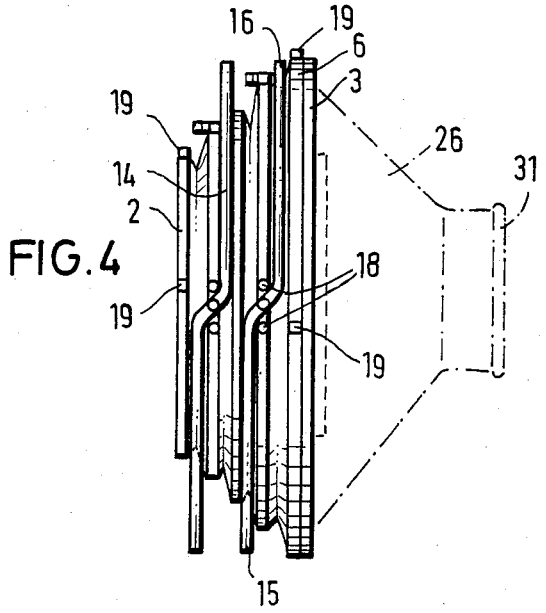
FIG. 4 is a side view of the folded bellow.
Figure 5:
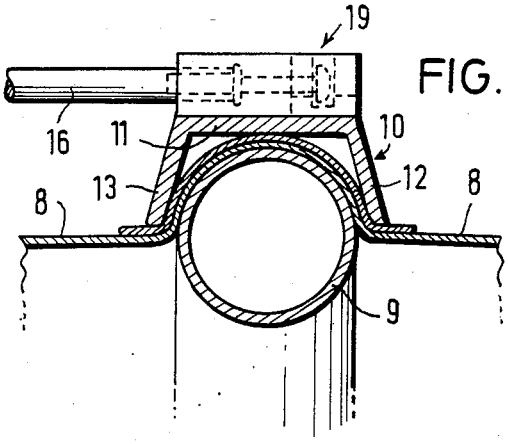
FIG. 5 is a cross section of a peripheral element.
Figure 6:
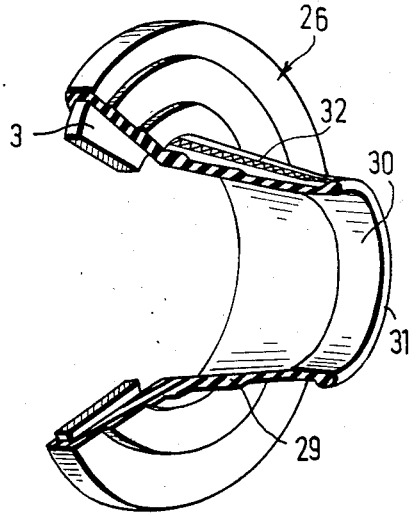
FIG. 6 is a perspective view of the sealing member and FIG. 7 is a rod connection element having at its ends a hinge-joint and swivel joints.

Rod arms 15,16 may be also distributed peripherally in a manner different from that shown in FIGS. 1 and 2. Above all, rods 14 of a longitudinal stiffening element 7 may be mounted differently in peripheral direction. In other words, each rod 14 will act independently upon the adjacent rod 14.

The end side 2 of bellow 1 is provided with connecting pieces 20,21 which may be connected for inst. with a suction source in order to generate a vacuum in the bellow 1.

The annular flange 3 at the one end side of the bellow 1 receives a sealing member 26 embracing the annular flange 3 to form a U-shape at both end sides and at the outer edge. The sealing member 26 is integrated with a conical portion 29 being tapered outwardly and ending in a nearly cylindrical ring 30 which is closed by a bead-type collar 31. Further, within the region of the conical section 29 and ring 30, there is provided an elongated vacuum-tight zip fastener 32 due to which the passage aperture of the sealing member 26 may be enlarged thus permitting a trouble-fee entrance into the sleeve or its application also with different body sizes. The sealing sleeve 26 forms an airtight end of the chamber. At the same time, its external part acts as a sealing between the annular flange 3 and the adjacent peripheral element 6. Further, between the bracing ring 10 of the respective peripheral member 6 and the annular flange 3, there is fitted an additional non-illustrated Moltopren seal.

The upper body portion of a testee projecting out of the sealing sleeve 26 is resting on a non-illustrated movable table.

To save weight, the annular flange 3 may be of an aluminum-honeycomb design. As evident from FIG. 2, it receives a lamellar slide 22 comprising several lamellar plates 23, for inst. three, adapted to be vertically displaceable so that the passage aperture of the annular flange 3 may be correspondingly accomodated to the upper body size of a testee. If vacuum pressure is applied, the flexible sealing sleeve 26 may join the lamellar plates 23 over the trunc of the testee. Thus, in case of vacuum pressure, the flexible sealing sleeve 26 is not withdrawn into the bellow interior and the testee is protected from probable pain. The aluminum lamellar plates 23 are guided in vertical profiled aluminum rails 24 fixed at the annular flange 3.

The operation of the apparatus will be now explained with reference to a blood circulation test: First off, by swivelling rods 14 into the horizontal abutment position, the bellow is pulled out to take a stretched position. The sealing sleeve 26 situated in the annular flange 3 at one end of the bellow will be opened by the zip 32 to allow access to the testee who may slide through the sealing sleeve to the rest surface 4 in the bellow 1 to take the right position in which the ring 30 of the sealing sleeve 26 encloses the body nearly about the waist. Subsequently, the lamellar plates 23 of the slide 22 are let down to the trunk of the person.

Thereafter, the vacuumtight zip fastener 32 is closed. Now, vacuum pressure may be produced in the bellow 1. This may be controlled by a suitable measuring instrument. As a rule, the vacuum pressure applied is about 0.133 bar. The upper body portion of the testee being outside the vacuum chamber, the proposed measurements may be performed substantially outside the vacuum chamber. Due to the transparent bellow material,, the effects of the vacuum pressure may be observed (dilatation).

The bellow is particularly suited to be used in orbital space where a space-saving, lightweight design of a vacuum chamber is needed.

What is claimed is:

1. In an apparatus for medical treatments, examinations or tests having a chamber configured to be connected to a vacuum source and including at one end thereof a passage aperture having a flexible sealing member, an improved chamber support structure adapted to be dismantled comprising:

a foldable bellow;

at least three substantially parallel peripheral members disposed to support the bellow, said peripheral members being capable of relative movement with respect to each other, a longitudinal stiffening element secured to a first one of the peripheral members by a hinge, said hinge enabling rotation of said longitudinal stiffening element from a first position substantially parallel to said first peripheral member to a second position substantially perpendicular to said first peripheral member, means for engaging said peripheral members to said stiffening element when said stiffening element is in said second position, whereby said stiffening element in said second position restrains relative movement among said peripheral members.

2. Apparatus according to claim 1, wherein said longitudinal stiffening element exerts an axial tension along the bellow in said second position while allowing a telescoping of the bellow in said first position.

3. Apparatus according to claim 1, wherein the longitudinal stiffening element comprises a rod which, in the second position, may be rigidly interconnected to at least two of the peripheral members.

4. Apparatus according to claim 1, wherein at least one of said peripheral members comprises:

a frame element disposed in the interior of the bellow, and a bracing element disposed on the exterior of the bellow, said bracing element being positioned to clamp a portion of the bellow material between the bracing element and the frame element.

5. Apparatus according to claim 4, wherein said stiffening element comprises a rod secured by said hinge to said bracing element, said rod having at least one end which may be detachably locked to an adjacent peripheral member.

6. Apparatus according to claim 5, wherein the rod comprises two axially offset, interconnected rod arms which are supported rotatably at said bracing element and whose respective ends are lockable with two adjacent peripheral members.

7. Apparatus according to claim 6, further comprising at least two longitudinal stiffening element arranged symmetrically about the periphery of the bellow, each of said stiffening elements having a different orientation with respect to the displacement of the rod arms.

8. Apparatus according to claim 6, wherein the rod arms are interconnected via a rod connecting element which is supported on the bracing element by means of a hinge joint.

9. Apparatus according to claim 8, wherein each of the rod arms is connected via a swivel joint to the ends of the rod connecting element so that the rod arms may be swivelled radially toward the bellow.

10. Apparatus according to claim 9, wherein the swivel joints further comprise a barrier for preventing the rod arms from swivelling radially away from the bellow.

11. Apparatus according to claim 9, further comprising two stops disposed adjacent to the hinge joint on the bracing element, said two stops acting to limit the swivel angle of the rod arms.

12. Apparatus according to claim 1, wherein the shape of the peripheral members is annular.

13. Apparatus according to claim 1, wherein the bellow is made of a transparent plastic sheet.

14. Apparatus according to claim 1, further comprising a lamellar slide positioned in said passage aperture, wherein the cross section of the passage aperture may be changed by displacement of the lamellar slide.

15. Apparatus according to claim 1, wherein the bellow is tapered from the end including the passage aperture to the end not including the passage aperture.

16. Apparatus according to claim 1, further comprising: a flexible rest surface disposed within the bellow and one or more retaining belts attached to the bellow at the end side having the passage aperture.

* * * * *